United States Patent [19]

Fukano et al.

[11] Patent Number: 4,908,674

[45] Date of Patent: Mar. 13, 1990

[54] IMAGE FORMING APPARATUS

[75] Inventors: Masahiko Fukano, Osaka; Mitsutoshi Takemoto, Yao, both of Japan

[73] Assignee: Mita Industrial Co., Ltd., Osaka, Japan

[21] Appl. No.: 313,611

[22] Filed: Feb. 22, 1989

[51] Int. Cl.[4] ..... G03G 15/00

[52] U.S. Cl. ..... 355/318; 355/309; 271/3.1

[58] Field of Search ..... 355/309, 318, 316, 317; 271/3.1, 9, 225

[56] References Cited

U.S. PATENT DOCUMENTS

| | | | |
|---|---|---|---|
| 4,304,485 | 12/1981 | Povio | 3255/318 X |
| 4,814,825 | 3/1989 | Johdai et al. | 355/318 X |
| 4,829,334 | 5/1989 | Takamatsu et al. | 355/309 |
| 4,835,567 | 5/1989 | Ogata | 355/318 |

*Primary Examiner*—A. C. Prescott

*Attorney, Agent, or Firm*—Beveridge, DeGrandi & Weilacher

[57] ABSTRACT

The image forming apparatus includes a paper delivery section for guiding paper to a space between a photoreceptor and a transferring corona discharger, the paper being guided as turned over after having passed between a pair of arcuate reversing guides. A portion of the paper delivery section is formed as a unit which can be integrally pulled out from the body of the apparatus. The apparatus further includes guide lifting and lowering means adapted to retreat downward the inner reversing guide out of the pair of reversing guides in association with a unit pulling operation, and adapted to lift up the inner reversing guide in association with a unit insertion operation. Accordingly, when the unit is inserted in and pulled out from the apparatus body, the guide lifting and lowering means vertically moves the inner reversing guide, thus preventing the inner reversing guide from coming into collision with the photoreceptor. The pair of reversing guides may be widely opened, facilitating a jam processing therebetween.

8 Claims, 10 Drawing Sheets

IMAGE FORMING APPARATUS

BACKGROUND OF THE INVENTION

The present invention relates to an image forming apparatus having a paper delivery section for delivering paper, as turned over, to a photoreceptor, a portion of the paper delivery section being formed as a unit which can be integrally pulled out from the body of the apparatus.

As electrophotographic copying machines, printers, facsimiles and the like, there are known image forming apparatus having a paper delivery section for guiding, to a photoreceptor, paper fed from a paper feed section such as a paper feed cassette disposed at the bottom of the apparatus, the paper being guided as turned over above the paper feed cassette. To facilitate a jam processing in such apparatus, a portion of the paper delivery section is formed as a unit which can be integrally pulled out from the apparatus body.

In the image forming apparatus having the arrangement above-mentioned, a pair of arcuate reversing guides are disposed between the photoreceptor and the resist rollers for guiding paper fed from the paper feed section to a space between the photoreceptor drum and the transferring corona discharger. To readily separate the paper from the photoreceptor by its own weight, the transferring corona discharger is disposed opposite to the lowermost portion of the photoreceptor. On the other hand, the tips of the reversing guides are disposed in the vicinity of the photoreceptor as standing close by the transferring corona discharger, such that the paper follows the photoreceptor securely and sufficiently.

According to the image forming apparatus having the arrangement above-mentioned, the tips of the reversing guides are located at positions higher than the lowermost portion of the photoreceptor. Accordingly, if it is intended to horizontally move the inner reversing guide to provide an open space between the reversing guides, the inner reversing guide comes in collision with the lower surface of the photoreceptor. Thus, in the conventional image forming apparatus, the inner reversing guide cannot be moved (pulled). Accordingly, the reversing guides cannot be released. This disadvantageously makes the jam processing difficult.

SUMMARY OF THE INVENTION

It is an object of the present invention to provide an image forming apparatus capable of facilitating a jam processing at a space between a pair of reversing guides.

To achieve the above object, the image forming apparatus in accordance with the present invention comprises:

a paper delivery section for guiding paper delivered from a paper feed section, to a space between a photoreceptor and a transferring corona discharger, the paper being guided as turned over after having passed through a space between a pair of arcuate reversing guides, a portion of the paper delivery section being formed as a unit which can be integrally pulled out from the body of the apparatus, the inner reversing guide out of the pair of reversing guides being attached to the unit at a predetermined position thereof so as to be movable between an original position in the vicinity of the photoreceptor and a retreat position which is lower than the original position and at which the inner reversing guide does not come into collision with the photoreceptor when the unit is pulled out; and guide lifting and lowering means adapted to retreat the inner reversing guide from the original position to the retreat position in association with a unit pulling operation, and adapted to return the inner reversing guide from the retreat position to the original position in association with a unit insertion operation.

According to the image forming apparatus having the arrangement above-mentioned, when pulling out the unit of the paper delivery section, the inner reversing guide may be pulled out together with the unit as retreated to a position lower than the photoreceptor by the guide lifting and lowering means. Accordingly, the pair of reversing guides may be opened, facilitating a jam processing between the reversing guides. When the unit is inserted upon completion of the jam processing, the inner reversing guide may be raised and returned to the original position by the guide lifting and lowering means.

EMBODIMENT

The following description will discuss in detail the present invention embodied as an electrophotographic copying apparatus, with reference to the attached drawings.

Figure 4:
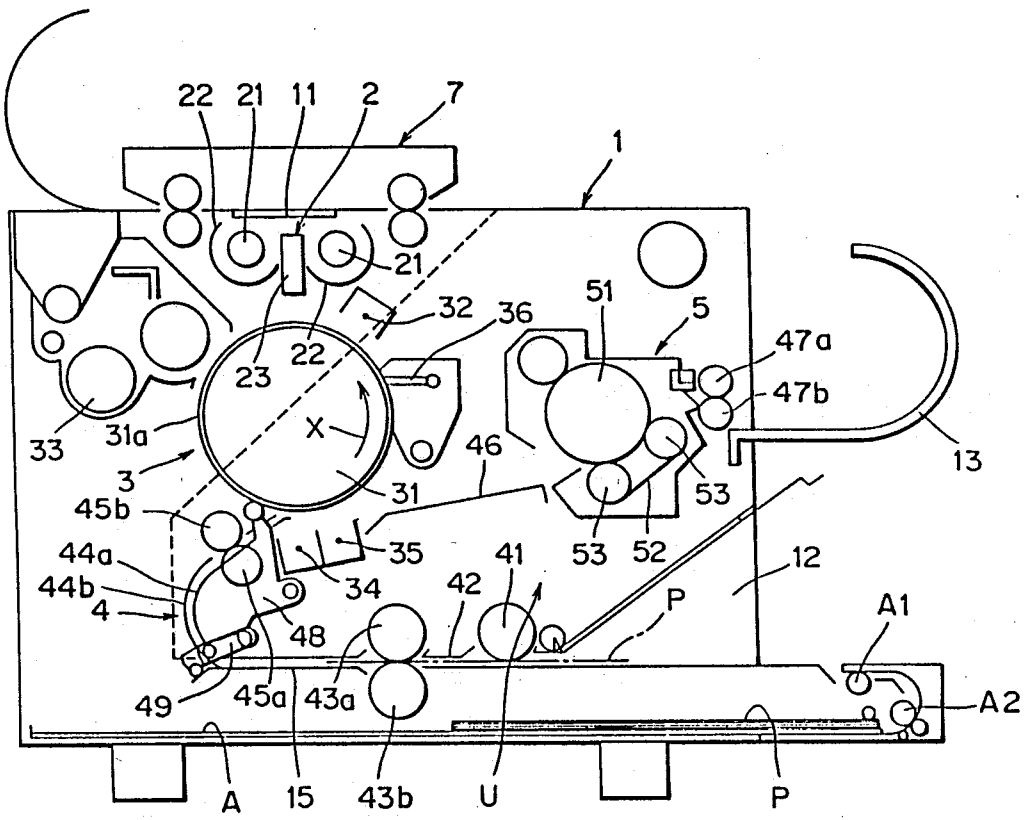
FIG. 4 is a schematic view of the inner arrangement of the electrophotographic copying apparatus.

In FIG. 4, the electrophotographic copying apparatus in accordance with the present invention has an optical section 2 disposed at the upper portion of the apparatus body 1 for scanning and exposing an original, a copying section 3 disposed under the optical section 2 for forming a reproduced image on paper P, a paper delivery section 4 extending from under the copying section 3 to the front end of the body 1 (at the right hand in FIG. 4) and fixing means 5 disposed at the front side (at the right hand in FIG. 4) of the paper delivery section 4 for fixing a toner image formed on the paper P.

The optical section 2 includes luminescent bodies 21, reflection plates 22, a lens 23 and the like and is adapted to scan and expose an original which is moved on a transparent platen 11 by original delivery means 7.

The copying section 3 includes a photoreceptor drum 31 rotatable in a direction shown by an arrow X in FIG. 4. The copying section 3 further includes a corona discharger 32, a developing device 33, a transferring corona discharger 34, a separating corona discharger 35 and a cleaning device 36, these members being disposed in this order along the direction X around the photoreceptor drum 31.

This copying section 3 is adapted to carry out a copying operation as outlined below.

The photoreceptor drum 31 is uniformly electrified by the corona discharger 32. An image corresponding to the original is formed on the photoreceptor drum 31. Based on the image thus formed, an electrostatic latent image is formed on the photoreceptor drum 31. The electrostatic latent image is developed as a toner image by the developing device 33. The toner image is then transferred on the paper P by the transferring corona discharger 34. Toner remaining on the photoreceptor drum 31 is then collected by the cleaning device 36.

The paper delivery section 4 includes a paper feed roller 41, a first guide 42, a pair of resist rollers 43*a*, 43*b*, a pair of second guides 44*a*, 44*b* each bent into a U-shape (hereinafter referred to as reversing guides), a pair of delivery rollers 45*a*, 45*b*, a third guide 46, and a pair of discharge rollers 47*a*, 47*b*, these members being disposed in this order from the inner part of a paper insertion portion 12 to a paper discharging side.

The paper delivery section 4 is adapted to deliver paper as outlined below.

The paper P fed from a paper feed cassette A or the paper inserting portion 12 is guided to the copying section 3 by the paper feed roller 41. The copying section 3 transfers a toner image onto the paper P, which is then guided to the fixing means 5. The fixing means 5 heats and fixes the toner image on the paper P, which is then discharged to a paper receiving stand 13. The paper feed cassette A is provided at the front end thereof with paper feed rollers A1, A2 for taking and feeding, one by one, papers P housed in the cassette A.

The fixing means 5 includes a heating roller 51 and a pressurizing belt 52 opposite thereto. The heating roller 51 is so driven as to be rotated at all times, while being heated to a predetermined temperature by heating means such as a heater incorporated therein. As guided into the fixing means 5, the paper P on which the toner image has been transferred, is delivered to the discharge rollers 47*a*, 47*b* by the heating roller 51, while the paper P is being pressed by the pressurizing belt 52 to the heating roller 51 under heating condition.

Figure 5:
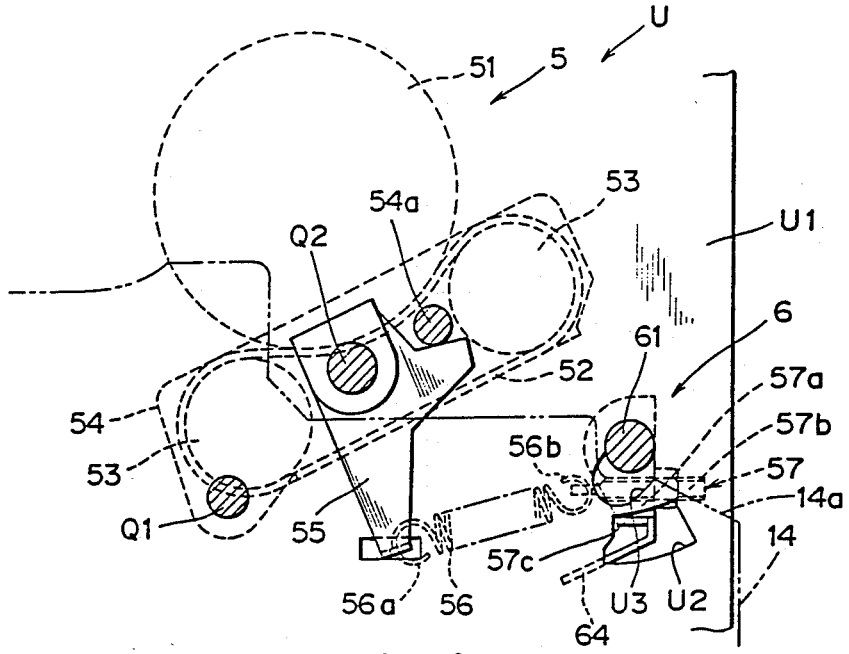
FIG. 5 and FIG. 6 are section views of fixing means and slide lock means, FIG. 5 being a section view taken along the line a—a in FIG. 8 to be discussed later and FIG. 6 being a section view taken along the line b—b in FIG. 8.
Figure 6:
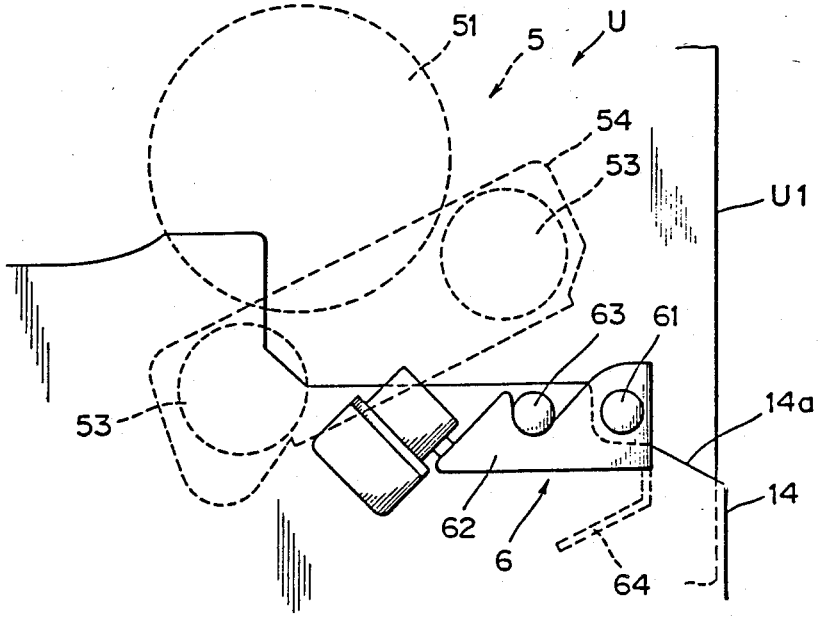
Figure 7:
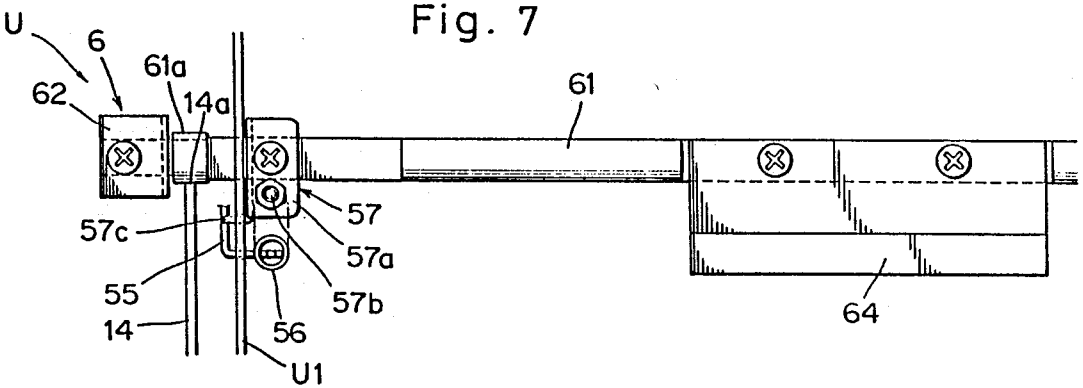
FIG. 7 is a side view of the slide lock means.
Figure 8:
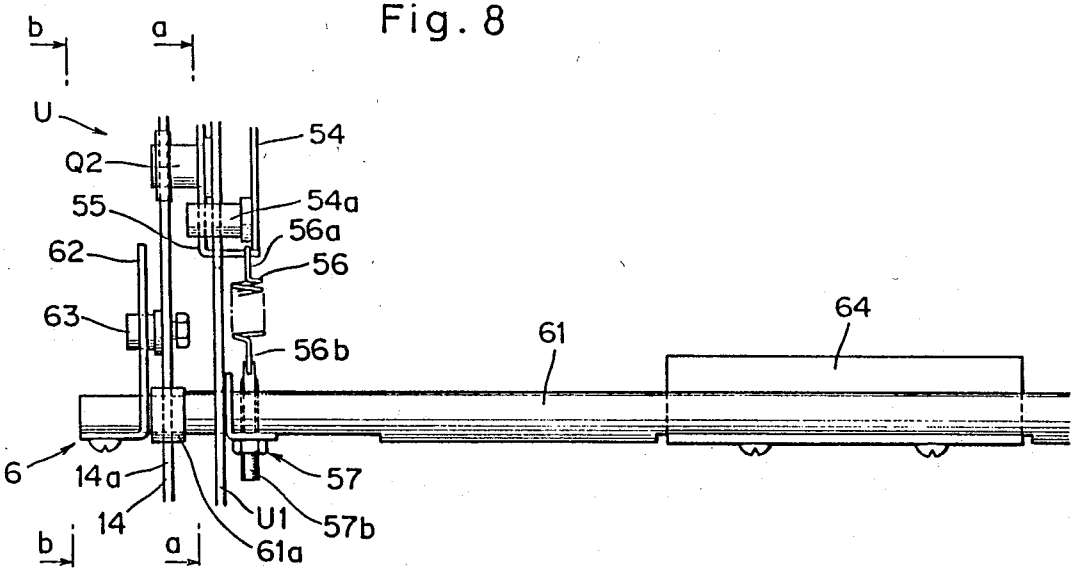
FIG. 8 is a plan view of the slide lock means.

In FIG. 5, the pressurizing belt 52 is pressed to the heating roller 51, as wound on a pair of drums 33 disposed at a predetermined spatial interval. The drums 53 are supported by a pair of frames 54 rotatable around a fulcrum Q1. The frames 54 are provided at the lateral sides thereof with engagement pins 54*a*. The lower surfaces of the engagement pins 54*a* are respectively engaged with a pair of levers 55 rotatable around a fulcrum Q2 (See FIG. 5 and FIG. 8). The levers 55 are resiliently rotatingly biased counterclockwise in FIG. 5 by coil springs 56 serving as resilient means. The coil springs 56 are tension springs and have one ends 56*a* engaged with the levers 55 and the other ends 56*b* connected to spring receiving members 57 integrally rotatably attached to a shaft 61 to be discussed later (See FIG. 4 to FIG. 8). In short, the pressurizing belt 52 is adapted to be movable toward and away from the heating roller 51, and is pressed to the heating roller 51 by the spring loads of the coil springs 56.

In the electrophotographic copying apparatus having the arrangement above-mentioned, a unit U in a unitary structure is formed by (i) the paper feed roller 41, the first guide 42, the upper resist roller 43*a*, the arcuate inner reversing guide 44*a*, the lower delivery roller 45*a*, the third guide 46 and the discharge rollers 47*a*, 47*b* of the paper delivery section 4, (ii) the transferring corona discharger 34 and the separating corona discharger 35 and (iii) the fixing means 5. The unit U is horizontally slidable so as to be integrally pulled out by a predetermined distance to the right hand in FIG. 4. Sliding of the unit U is restricted by a pair of 5 slide lock means 6.

As shown in FIGS. 5 to 8, the slide lock means 6 include the shaft 61 inserted in and passing through a pair of lateral plates U1 of the unit U, a pair of lock levers 62 integrally rotatably mounted on both ends of 0 the shaft 61, and a pair of lock pins 63 projecting from lateral plates 14 of the apparatus body 1 and respectively engageable with the lock levers 62. The shaft 61 is provided at the center thereof with an operating lever 64. When the shaft 61 is rotated by the operating lever 64, the lock levers 62 are disengaged from the lock pins 63. This enables the unit U to be pulled out.

The shaft 61 has a pair of spring receiving members in the vicinity of the inner surfaces of the lateral plates U1, respectively. The spring receiving members 57 have hanging portions 57*a* projecting under the shaft 61. The coil springs 56 have the other ends 56*b* connected to the hanging portions 57*a* through screw pins 57*b* for tension adjustment. Accordingly, the shaft 61 and the lock levers 62 are rotatingly biased normally clockwise in FIGS. 5 and 6, by the coil springs 56. Thus, the engagement of the lock levers 62 with the lock pins 63 is maintained. The hanging portions 57*a* of the spring receiving members 57 are provided at the lower ends thereof with transversely projecting engagement portions 57*c*. The engagement portions 57*c* are engaged with through-holes U2 (See FIG. 5) formed in the lateral plates U1 of the unit U. Such engagement prevents the lock levers 62 from being unnecessarily rotated clockwise when the unit U is pulled out.

Figure 9:
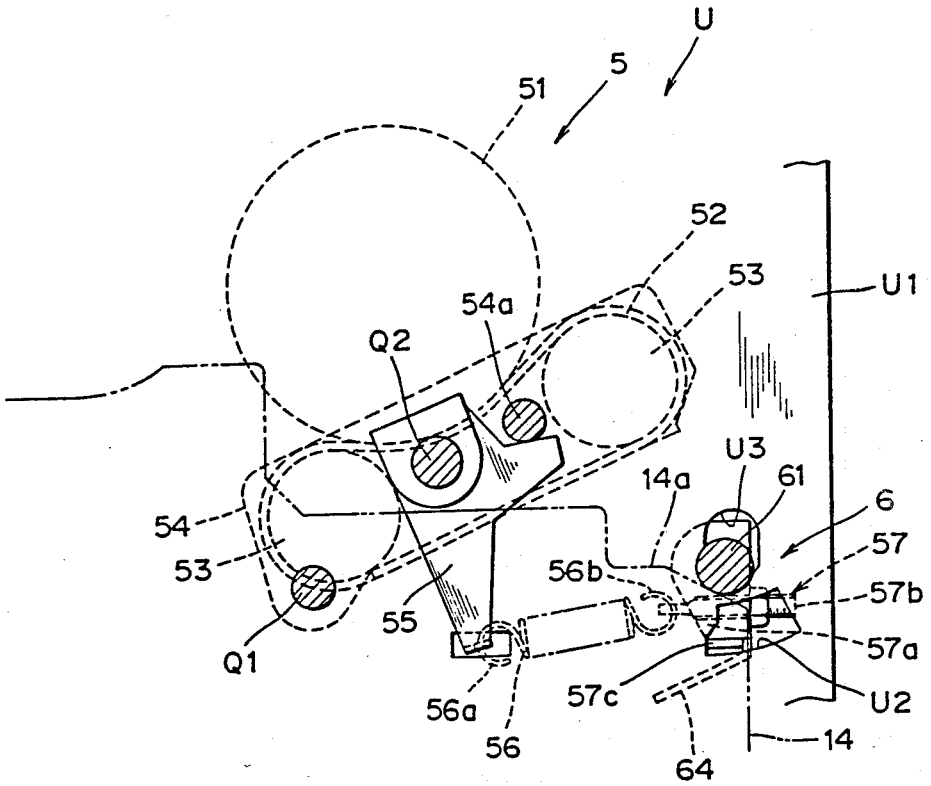
FIG. 9 is a section view of the fixing means and the slide lock means, illustrating that the pressure contact of a heating roller with a pressurizing belt is released.

To insert and pass the shaft 61 in and through the lateral plates U1 of the unit U, the lateral plates U1 have slot-like through-holes U3 inclined downward in the left direction in FIG. 5. When the unit U is locked, the shaft 61 inserted in the through-holes U3 is received by cam surfaces 14*a* of the lateral plates 14 of the apparatus body 1 and located in the upper portions of the through-holes U3. The front ends of the cam surfaces 14*a* are inclined downward toward the right hand in FIG. 5 such that, as the unit U is pulled out, the shaft 61 is moved gradually downward and finally to the lower portions of the through-holes U3. Accordingly, in association with the unit pulling operation, the shaft 61 and the spring receiving members 57 are moved downward in the left direction. This causes the coil springs 56 to be loosened, releasing the pressure contact of the heating roller 51 with the pressurizing belt 52, as shown in FIG. 9.

In such a state, paper P remaining, as jammed, between the heating roller 51 and the pressurizing belt 52 may be readily removed. Further, since the heating roller 51 is not completely separated from the pressurizing belt 52, this reduces the possibility of the hand touching the heating roller 51 at the time of jam processing. Further, the paper delivery passage may be widely opened by pulling the unit U. This facilitates the jam processing in the entire paper delivery passage. Sleeves 61*a* are put on the shaft 61 at the portions thereof in contact with the cam surfaces 14*a*, thereby to achieve a smooth sliding of the shaft 61 with respect to the cam surfaces 14*a* (See FIG. 7).

Figure 1:
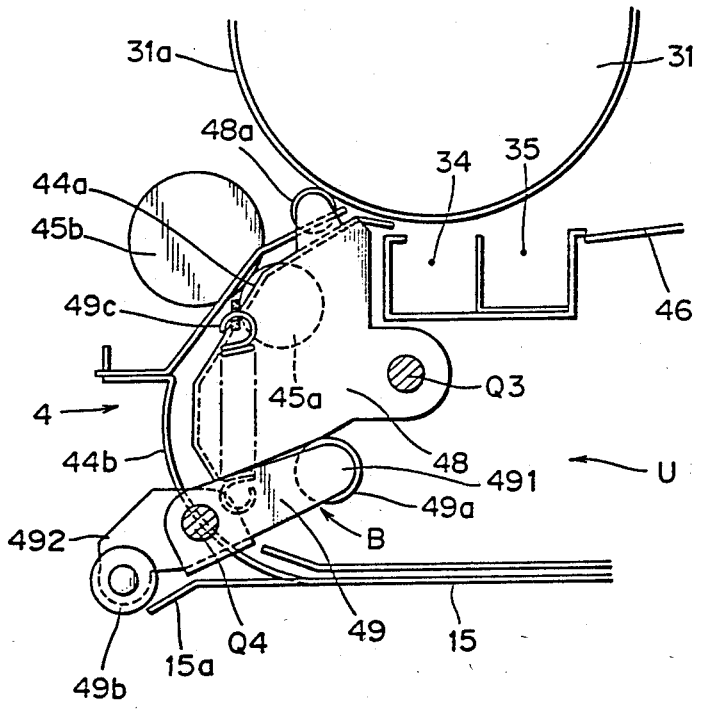
FIG. 1 is a schematic view of main portions in the vicinity of a pair of reversing guides of electrophotographic copying apparatus in accordance with the present invention.
Figure 2:
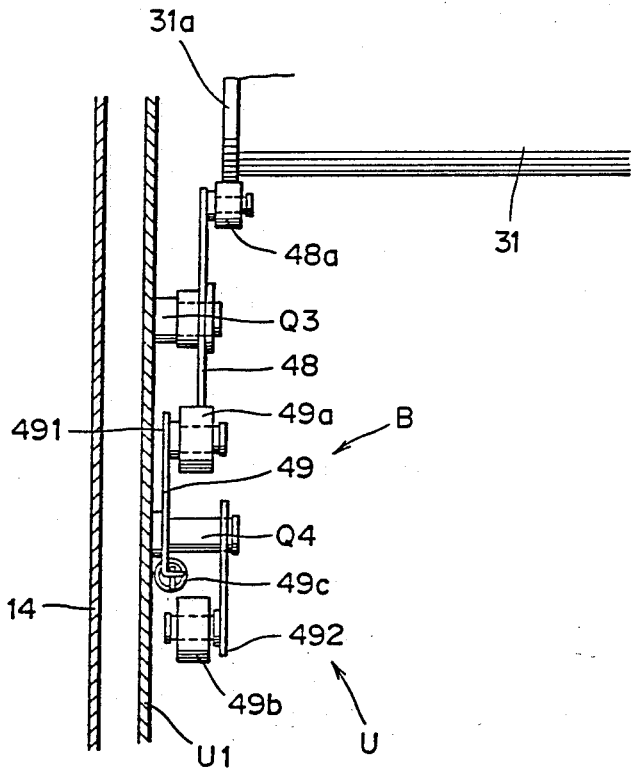
FIG. 2 is a schematic view in side elevation of FIG. 1.
Figure 3:
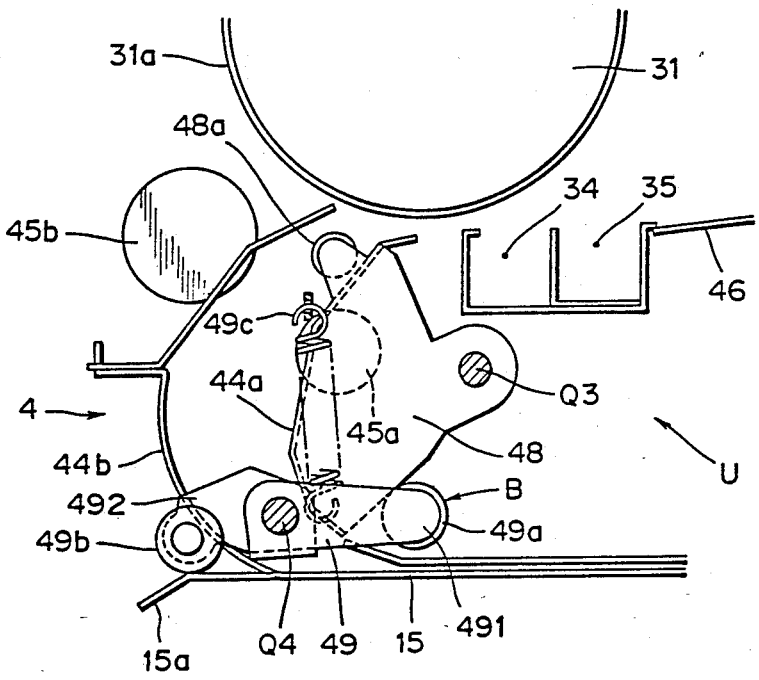
FIG. 3 is a schematic view of the main portions in FIG. 1 with the inner reversing guide moved downward.

The following description will discuss with reference to FIG. 1 to FIG. 3.

When the unit U is pulled out, the inner reversing guide 44*a* is automatically moved downward by guide lifting and lowering means B having spring-load applying means and spring-load releasing means, such that the inner reversing guide 44*a* does not come in contact with the photoreceptor drum 31.

The spring-load applying means includes swing levers 49 and coil springs 49*c* serving as spring means. The spring-load releasing means includes cam rails 15.

More specifically, the inner reversing guide 44*a* is held so as to be permitted to be rotated downward, by a pair of frames 48 mounted respectively on the lateral plates U1 of the unit U in a manner rotatable around a fulcrum Q3. The frames 48 are raised to the reference position shown in FIG. 1, by the swing levers 49 supported by the lateral plates U1 in a manner rotatable around a fulcrum Q4. The swing levers 49 are provided at one ends thereof 491 with rollers 49*a* adapted to come in rolling contact with the frames 48. The swing levers 49 are provided at the other ends thereof 492 with cam followers 49*b* adapted to come in rolling contact with the cam rails 15 secured to the apparatus body 1. The swing levers 49 are rotatingly biased normally counterclockwise in FIG. 1 by the coil springs 49*c*. The coil springs 49*c* are tension springs.

The cam rails 15 have ends 15*a* inclined downward. When the unit U is set to the normal position, the cam followers 49*b* of the swing levers 49 come in contact with or adjacent to the inclined ends 15*a* of the cam rails 15. The upper portions of the frames 48 come in contact with a frange 31*a* of the photoreceptor drum 31 through rollers 48*a*. Accordingly, the frames 48 and the inner reversing guide 44*a* are prevented from rotating excessively over a predetermined angle clockwise in FIG. 1. This causes the inner reversing guide 44*a* to be positioned with respect to the photoreceptor drum 31.

With the arrangement above-mentioned, when the unit U is pulled out from the body 1, the swing levers 49 are rotated clockwise with the cam followers 49*b* thereof rotated and moved along the cam rails 15. This enables the frames 48 to be rotated downward by their own weights. This prevents the inner reversing guide 44*a* from coming into collision with the photoreceptor drum 31 (See FIG. 3). Accordingly, the paper delivery passage between the reversing guides 44*a* and 44*b* may be widely opened to facilitate the jam processing thereat. Upon completion of the jam processing, the unit U may be inserted into the original position. The inner reversing guide 44*a* may be lifted up and returned to the original position by the guide lifting and lowering means B.

Further, the swing levers 49 are rotated with the cam followers 49*b* coming in rolling contact with the cam rails 15. This assures a smooth rotation of the swing levers 49. Accordingly, pulling and insertion of the unit U may be smoothly achieved.

With the rotation thereof, the swing levers 49 push up the frames 48 with the rollers 49*a* coming in rolling contact therewith. Thus, the frames 48 may be smoothly pushed up.

Figure 10:
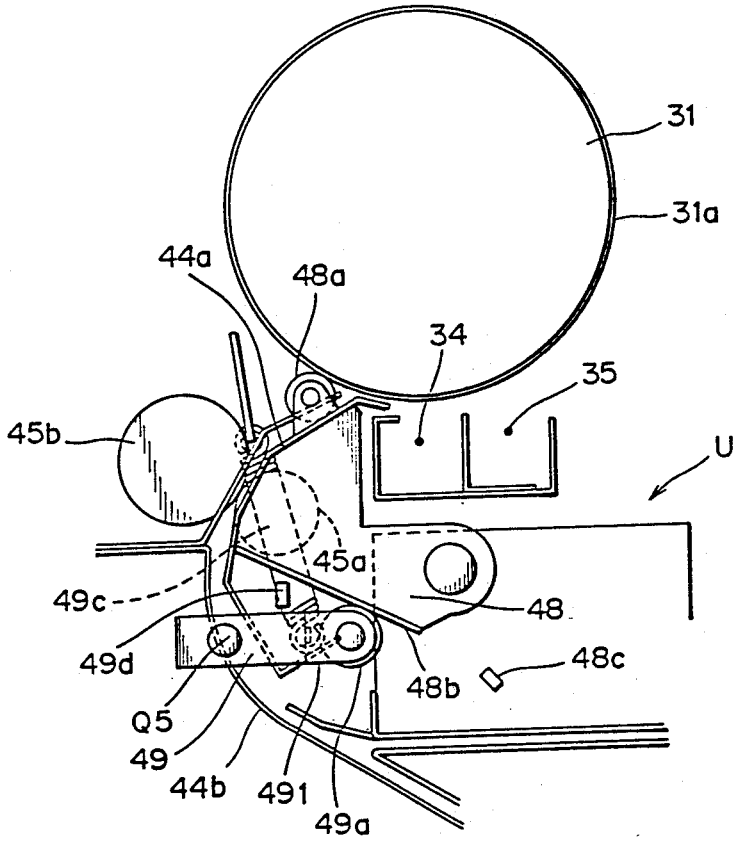
FIG. 10 is a schematic view of main portions of another example of guide lifting and lowering means.

FIG. 10 shows another example of the guide lifting and lowering means B. In FIG. 10, the guide lifting and lowering means B includes swing levers 49 and coil springs 49*c* serving as spring means.

Figure 11:
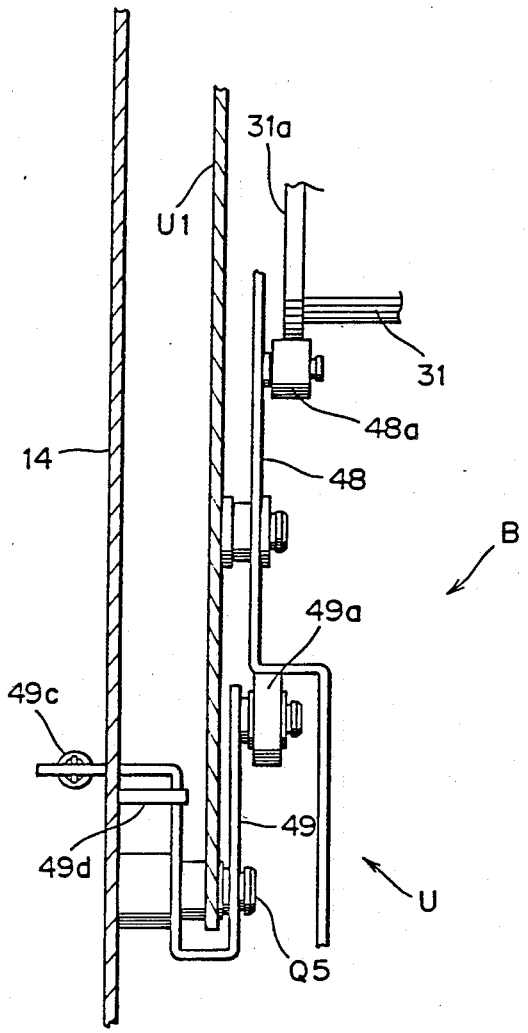
FIG. 11 is a schematic view in side elevation of the guide lifting and lowering means in FIG. 10.

More specifically, the inner reversing guide 44*a* is held so as to be permitted to be rotated downward, by the frames 48 rotatably attached to the lateral plates U1 of the unit U. The frames 48 are lifted to a predetermined position by the swing levers 49, respectively. The swing levers 49 are supported by the lateral plates 14 of the body 1 in a manner rotatable around a fulcrum Q5 (See FIG. 11). The tips of the swing levers 49 come in contact with engagement portions 48*b* projecting from the ends of the frames 48, through rollers 49*a*.

Figure 12:
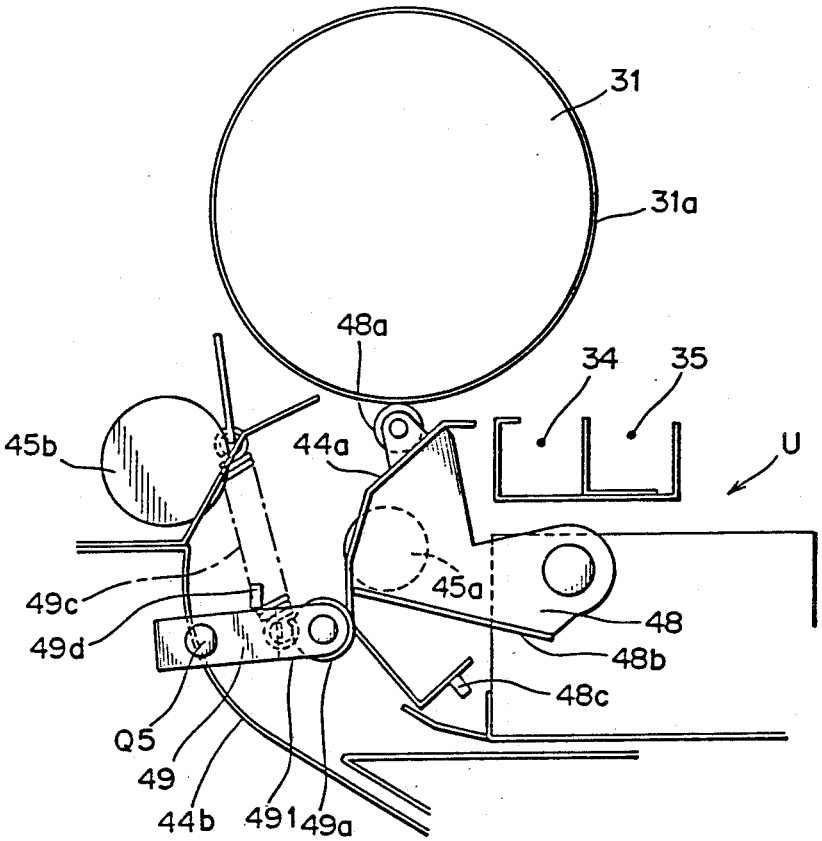
FIG. 12 is a schematic view of main portions in the vicinity of a pair of reversing guides with the inner reversing guide moved downward.

The engagement portions 48*b* are formed as inclined surfaces obliquely inclined upward (See FIG. 10). Provision is made such that the left ends of the engagement portions 48*b* are located at positions higher than the tops of the rollers 49*a* of the swing levers 49 when the frames 48 are rotated downward (See FIG. 12). One ends 491 of the swing levers 49 are rotatingly biased normally counterclockwise by the coil springs 49*c* attached to the lateral plates 14 of the body 1. Stoppers 49*d* projecting from the lateral plates 14 prevent the swing levers 49 from being rotated counterclockwise unnecessarily when the rollers 49*a* are disengaged from the engagement portions 48*b*. The upper rollers 48*a* of the frames 48 come in contact with the frange 31*a* of the photoreceptor 31. This enables the frames 48 to be positioned with respect to the photoreceptor 31.

With the arrangement above-mentioned, when the unit U is pulled out from the apparatus body 1, the frames 48 are gradually rotated counterclockwise with the engagement portions 48*b* thereof moved along the rollers 49*a* of the swing levers 49. This enables to widely open the paper delivery passage between the reversing guides 44*a* and 44*b* (See FIG. 12). By suitably selecting the inclination angles of the engagement portions 48*b*, the frames 48 may be rotated such that the upper portion of the inner reversing guide 44*a* does not come into collision with the photoreceptor drum 31. The stoppers 48*c* projecting from the lateral plates U1 of the unit U prevent the frames 48 from being unnecessarily rotated downward when they are in a free state.

When the unit U once pulled out is inserted again, the frames 48 may be rotated clockwise with the engagement portions 48*b* thereof moved along the rollers 49*a* of the swing levers 49. The inner reversing guide 44*a* may be finally lifted and returned to the original position.

According to the arrangement shown in FIG. 10, the operation of inserting the unit U again after considerably pulled out from the apparatus body 1, may be particularly facilitated as compared with the arrangement shown in FIG. 1.

More specifically, when the unit U is considerably pulled out from the body 1 in the arrangement in FIG. 1, the cam followers 49*a* of the swing levers 49 are disengaged from the cam rails 15, and the swing levers 49 are rotated counterclockwise by the spring loads of the coil springs 49*c*. Accordingly, when the unit U is inserted again, it is required to rotate the swing levers 49 once rotated as above-mentioned, clockwise at a predetermined angle such that the cam followers **49*b* are placed on the cam rails 15. According to the arrangement in FIG. 10, the swing levers 49 are disposed at the side of the apparatus body 1. Therefore, the unit U may be loaded on the body 1** at a predetermined position thereof by merely pushing the unit U.

In the embodiments above-mentioned, the shaft 61 is provided at both ends thereof with the slide lock means 6. However, the shaft 61 may be provided at either end thereof with the slide lock means 6.

Figure 13:
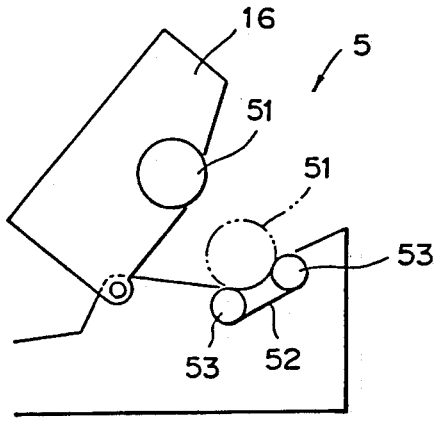
FIG. 13 is a schematic view of another example of the fixing means.

The present invention should not be limited to the embodiments above-mentioned, but variations and modifications thereof may be made. For example, as shown in FIG. 13, the heating roller 51 of the fixing means 5 may be rotated upward together with a housing 16 of the fixing means. In this case, the heating roller 51 may be separated from the pressurizing belt 52, causing the belt 52 to be perfectly exposed. This facilitates the replacement of the pressurizing belt 52, if necessary.

The fixing means 5 may use a pressurizing roller, instead of the pressurizing belt 52.

The guide lifting and lowering means B may be disposed only at one lateral plate U1 of the unit U. This may also be applied to the slide lock means.

In the above-described embodiments, tension springs are employed as the coil springs **49*c* and 56**. However, compression springs and torsion springs may also be employed.

The present invention may be embodied as other image forming apparatus such as a facsimile, printer and the like, than an electrophotographic copying machine.

According to the image forming apparatus of the present invention, when the unit of the paper delivery section is pulled out, the inner reversing guide out of a pair of reversing guides may be pulled out together with the unit, as retreated to a position lower than the photoreceptor by the guide lifting and lowering means. This enables to widely open the pair of reversing guides, facilitating a jam processing at a space therebetween.

What is claimed is:

1. An image forming apparatus comprising:

a paper delivery section for guiding paper delivered from a paper feed section, to a space between a photoreceptor and a transferring corona discharger, said paper being guided as turned over after having passed between a pair of arcuate reversing guides, a portion of said paper delivery section being formed as a unit which can be integrally pulled out from the body of said apparatus, the inner reversing guide out of said pair of reversing guides being attached to said unit at a predetermined position thereof so as to be movable between an original position in the vicinity of said photoreceptor and a retreat position which is lower than said original position and at which said inner reversing guide does not come into collision with said photoreceptor when said unit is pulled out; and guide lifting and lowering means adapted to retreat said inner reversing guide from said original position to said retreat position in association with a unit pulling operation, and adapted to return said inner reversing guide from said retreat position to said original position in association with a unit insertion operation.

2. An image forming apparatus according to claim 1, wherein the inner reversing guide is supported by frames rotatably attached to the lateral plates of the unit, and the guide lifting and lowering means includes (i) spring-load applying means for rotatingly biasing said frames upward when the unit is inserted, and (ii) spring-load releasing means for releasing said frames biased by said spring-load applying means to permit said frames to be rotated downward in association with the unit pulling operation.

3. An image forming apparatus according to claim 2, wherein the spring-load applying means includes swing levers rotatably attached to the lateral plates of the unit and spring means for rotatingly biasing said swing levers, and the spring-load releasing means includes cam rails attached to the body of said apparatus.

4. An image forming apparatus according to claim 3, wherein the swing levers are provided at the lower ends thereof with cam followers, said swing levers being adapted to be rotated with said cam followers coming in rolling contact with the cam rails when the unit is pulled out and inserted.

5. An image forming apparatus according to claim 3, wherein the swing levers are provided at the upper ends thereof with rollers, said swing levers being adapted to push up the frames with said rollers coming in rolling contact with the frames.

6. An image forming apparatus according to claim 2, wherein the frames have rollers by which the inner reversing guide is positioned with respect to the photoreceptor when the unit is inserted.

7. An image forming apparatus according to claim 1, wherein the inner reversing guide is supported by frames rotatably attached to the lateral plates of the unit, and the guide lifting and lowering means includes rotation levers engaged with said frames for vertically moving said frames, and spring means for biasing said rotation levers upward.

8. An image forming apparatus according to claim 7, wherein the rotation levers are provided at the upper ends thereof with rollers, said rotation levers being adapted to push up the frames with said rollers coming in rolling contact with the frames.

* * * * *